US006260537B1

(12) United States Patent
Lamb et al.

(10) Patent No.: US 6,260,537 B1
(45) Date of Patent: Jul. 17, 2001

(54) SIDE FEED FUEL INJECTOR AND INTEGRATED FUEL RAIL/INTAKE MANIFOLD

(75) Inventors: Curtis David Lamb, Scottsville; Frederick Smith, Conesus, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/248,410

(22) Filed: Feb. 11, 1999

Related U.S. Application Data

(60) Provisional application No. 60/075,611, filed on Feb. 20, 1998.

(51) Int. Cl.[7] ..... F02M 55/02
(52) U.S. Cl. ..... 123/456; 123/468
(58) Field of Search ..... 123/456, 470, 123/468, 469, 184.47

(56) References Cited

U.S. PATENT DOCUMENTS 4,776,313 * 10/1988 Freismuth et al. ..... 123/470
4,966,120 * 10/1990 Itoh et al. ..... 123/516
5,058,555 * 10/1991 Haboush II et al. ..... 123/470
5,070,844 * 12/1991 Daly ..... 123/456
5,163,406 * 11/1992 Daly et al. ..... 123/456

* cited by examiner

*Primary Examiner*—Henry C. Yuen
*Assistant Examiner*—MAhmoud Gimie
(74) *Attorney, Agent, or Firm*—John A. VanOphem

(57) ABSTRACT

An intake manifold assembly includes an improved air intake manifold receiving novel side feed fuel injectors. A fuel rail is integrated as a common part defining a common fuel passage integral with the air intake manifold. The common fuel passage supplies the side feed fuel injectors through openings that are spaced away from the injector nozzles toward an opposite connector end of each injector. The injector design concentrates an actuating coil, armature and nozzle valve in a lower or nozzle end of the injector. The fuel is fed from the side feed opening through an axially centered fuel passage that extends through the coil and the associated armature to the injection valve in a manner identical to corresponding top feed injectors. Thus, the performance advantages of top feed injection systems are provided while gaining the reduction in cost attributable to elimination of the separate fuel rail and subassembly. Various arrangements are disclosed for retaining the injectors in the manifold assembly.

11 Claims, 8 Drawing Sheets

SIDE FEED FUEL INJECTOR AND INTEGRATED FUEL RAIL/INTAKE MANIFOLD

This application claims the benefits of the claims filed in Provisional Application Ser. No. 60/075,611 filed Feb. 20, 1998.

TECHNICAL FIELD

This invention relates to engine air intake manifolds and fuel injectors and, more particularly, to intake manifolds with integrated fuel rails, their combination with side feed fuel injectors and to side feed fuel injectors for use in such manifolds.

BACKGROUND OF THE INVENTION

It is known in the art relating to engine intake manifolds to provide a manifold assembly including a manifold having a plurality of air intake passages connected with a plenum and having injector pockets connecting with the air passages. Top feed fuel injectors secured in assembly with a separate fuel rail are received in the injector pockets for selectively delivering fuel to the air intake passages to create a combustible air fuel mixture for delivery to the cylinders of an associated engine. Side mounted electrical connectors provide for connection of the injectors to an actuating electric power source.

An alternative manifold assembly provides an internal common fuel passage that acts as a fuel rail connecting with a plurality of injector pockets. Bottom feed fuel injectors are secured in the injector pockets and receive fuel from the common fuel passage through bottom feed openings. The fuel enters the bottom feed injectors between injection valve seats at the nozzle end of the injectors and an actuating coil and armature which actuate the injection valve through an axially extending rod or needle valve.

The top feed fuel injection system has provided better performance than the bottom feed system which has led to wide usage of the top feed system in spite of the additional costs associated with the separate fuel rail and additional subassembly operations involved in its manufacture.

SUMMARY OF THE INVENTION

The present invention provides an improved intake manifold and manifold assembly utilizing novel side feed fuel injectors. The fuel rail is integrated as a common part defining a common fuel passage integrated with the air intake manifold. The common fuel passage supplies the side feed fuel injectors through openings that are spaced away from the injector nozzle toward an opposite connector end of the injector. The injector concentrates the actuating coil, armature and nozzle valve in the lower or nozzle end of the injector and the fuel is fed from the side feed opening through an axially centered central fuel passage that extends through the coil and the associated armature to the injection valve in a manner identical to corresponding top feed injectors. Thus, the performance advantages of top feed fuel injection systems are provided while gaining the reduction in cost attributable to elimination of the separate fuel rail and subassembly.

These and other features and advantages of the invention will be more fully understood from the following description of certain specific embodiments of the invention taken together with the accompanying drawings.

DESCRIPTION OF THE PREFERRED EMBODIMENT

Figure 1:
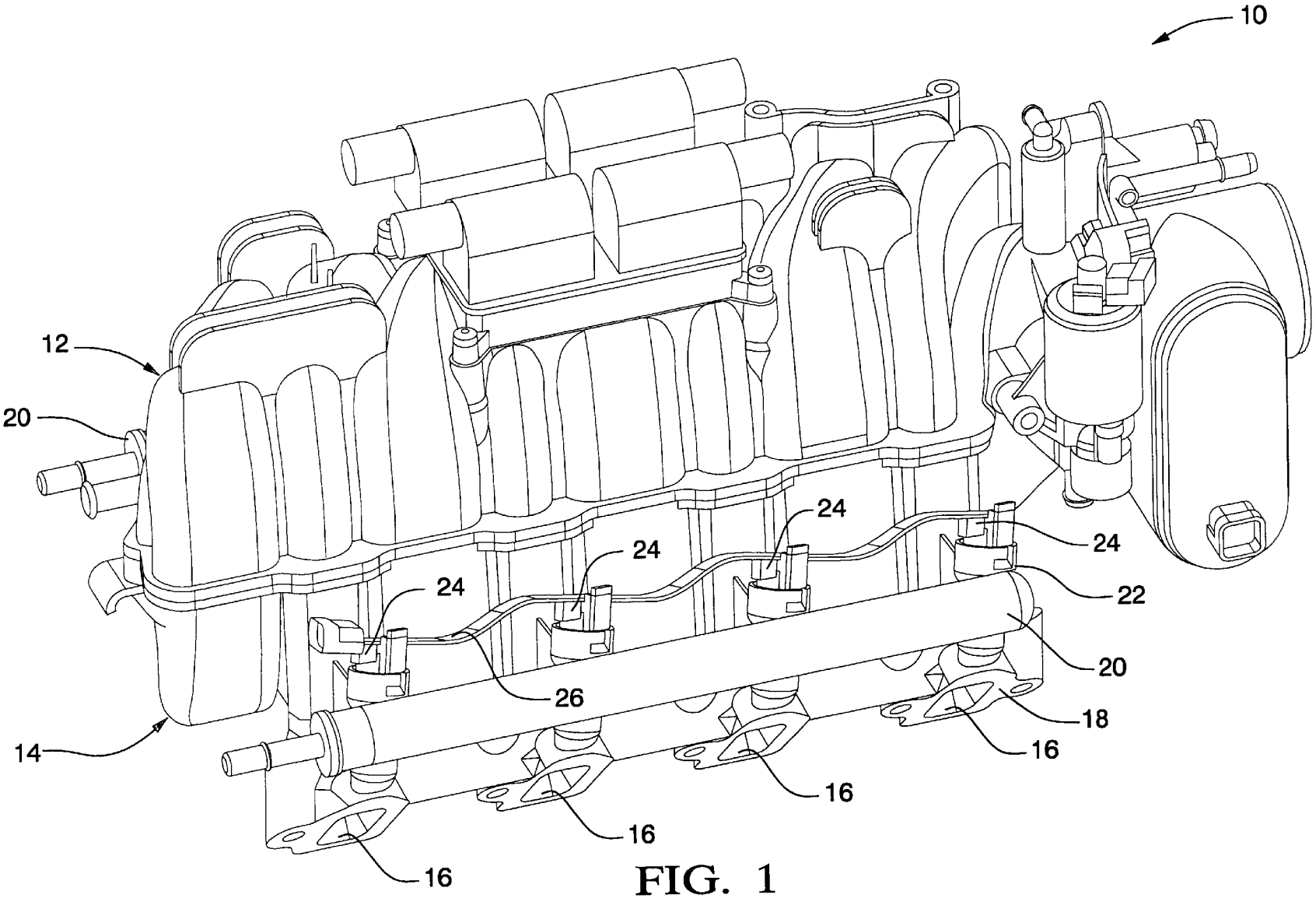
FIG. 1 is a complete intake manifold assembly including a manifold with an integrated fuel rail and side feed injectors in accordance with the invention.

Referring first to FIG. 1 of the drawings in detail, numeral 10 generally indicates an engine intake manifold assembly formed according to the invention. Assembly 10 includes upper and lower sections 12 and 14, respectively, which internally define a plenum, not shown, that connects through individual runners with a plurality of air intake passages 16. Passages 16 extend to machined faces 18 on either side of the manifold which are connectable with associated engine cylinder heads for connection of the intake passages with associated engine cylinder inlet ports, not shown. Along both sides of the manifold, there are formed integral fuel rails 20 that internally define common fuel passages, each connecting with a plurality of generally cylindrical pods 22 defining internal pockets, not shown. Within each of the pockets there is mounted a side feed fuel injector 24 formed in accordance with the invention. The injectors are electrically connected with a flexible connector 26 adapted for connection to an electrical power source for actuating the injectors.

Figure 2:
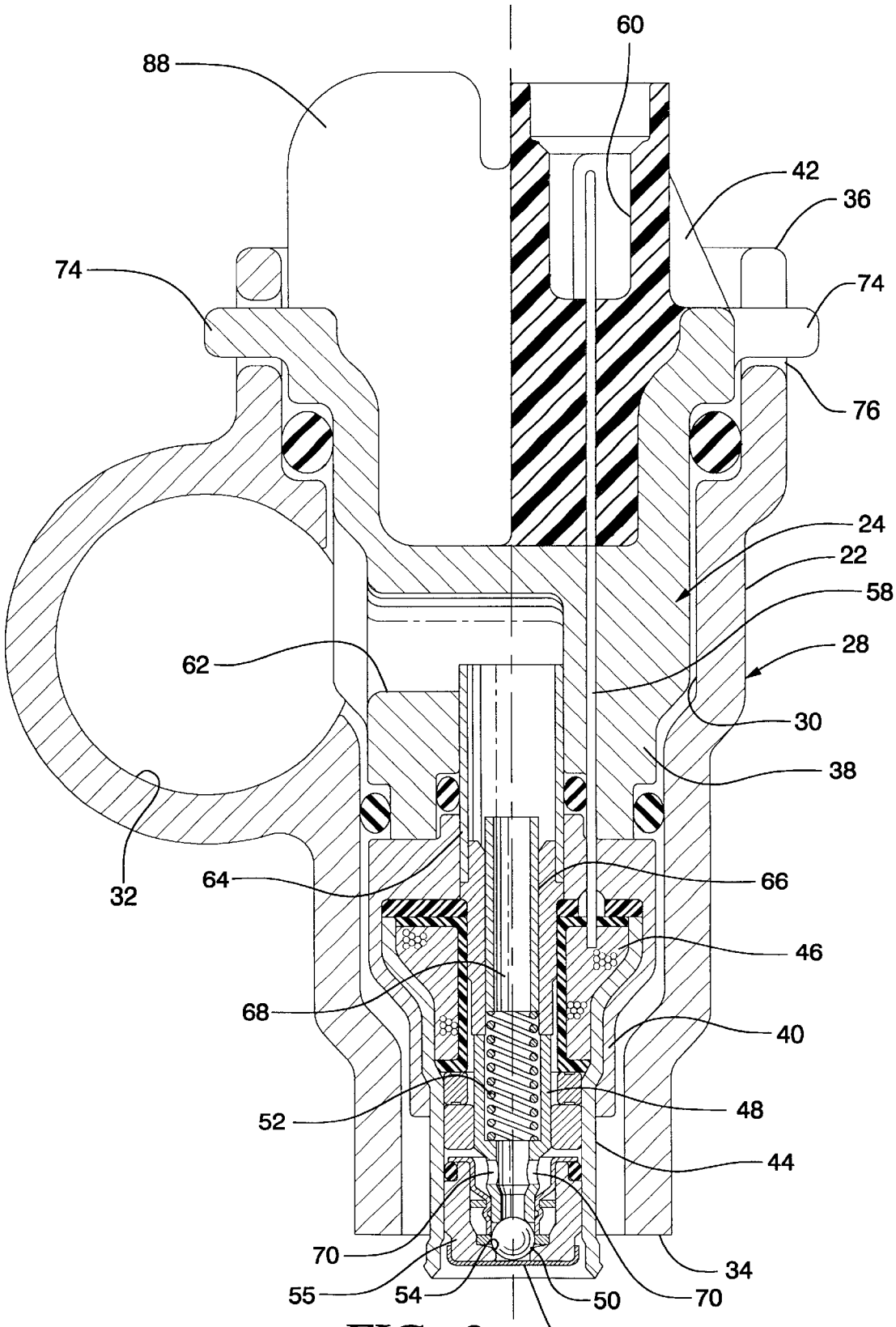
FIG. 2 is cross-sectional view showing the interior of a side feed injector according to the invention as mounted in an exemplary intake manifold assembly.

Referring now to FIG. 2, there is shown a portion of a manifold 28 including a pod 22 internally defining a drop-through injector pocket 30 in which a side feed fuel injector 24 is mounted. Manifold 28 also includes an integral common fuel passage 32 which performs the function of a fuel rail. Passage 32 communicates with the injector pocket 30 between its ends which include one end 34 that is adapted to communicate with a manifold air intake passage, not shown, and an opposite second end 36 through which the side feed fuel injector 24 is inserted or withdrawn.

Injector 24 includes a body 38, which may be formed in two parts, defining a nozzle end 40 and a connector end 42. At the nozzle end is an injection assembly 44 including an electrical actuating coil 46. The coil 46 is operable to actuate an armature 48 connected with an injection valve 50. A spring 52 urges the valve 50 against a valve seat 54 for closing a nozzle opening or orifice in a nozzle member 55.

An orifice plate 56 on the end of the nozzle member includes orifices, not shown, for atomizing fuel discharged through the nozzle opening. The actuating coil 46 connects through conductors 58, only one of which is shown, with a connector socket 60 on the connector end of the body for connecting the coil 46 with an electrical power source.

Within the injector body 38 is an internal fuel passageway including a side feed opening 62 that connects internally with an axially extending connector tube 64. Tube 64 communicates with an axially centered adjusting tube 66 that compresses spring 52 to a predetermined desired preload force. The tube 66, spring 52 and upper portions of the armature 48 and injection valve 50 define an axially centered central fuel passage 68 that extends through the coil 46 and armature 48 to openings 70 in the injection valve 50. From there, the fuel passageway continues outside the injection valve through a nozzle member 72 to the valve seat 54.

It should be noted that the injection assembly 44 positioned toward the nozzle end of the injector and the central fuel passage 68 extending through the injection assembly are essentially identical to the corresponding portions of prior top feed injectors which have been previously in use. Thus, the location of the side feed opening 62 above the injection assembly 44 and passage 68, allows fuel to enter and pass through the injector with the same degree of efficiency and freedom of flow as in the corresponding top feed injectors. Concentration of the injection assembly 44 at the lower end of the injector also allows the mass of the injection valve and connecting components to be minimized, thus contributing to the performance improvement of this form of injector over known bottom feed injection systems.

It is noted that O-ring seals are utilized at various places within the injector and between the injector body and the associated injector pocket 30 in order to prevent the undesired leakage of fuel within and from the assembly. In addition, the connector end 42 of the injector is provided with laterally extending lugs 74 which are engaged in L-shaped slots 76 that are also shown in the FIG. 1 embodiment and will be subsequently further described.

Figure 3:
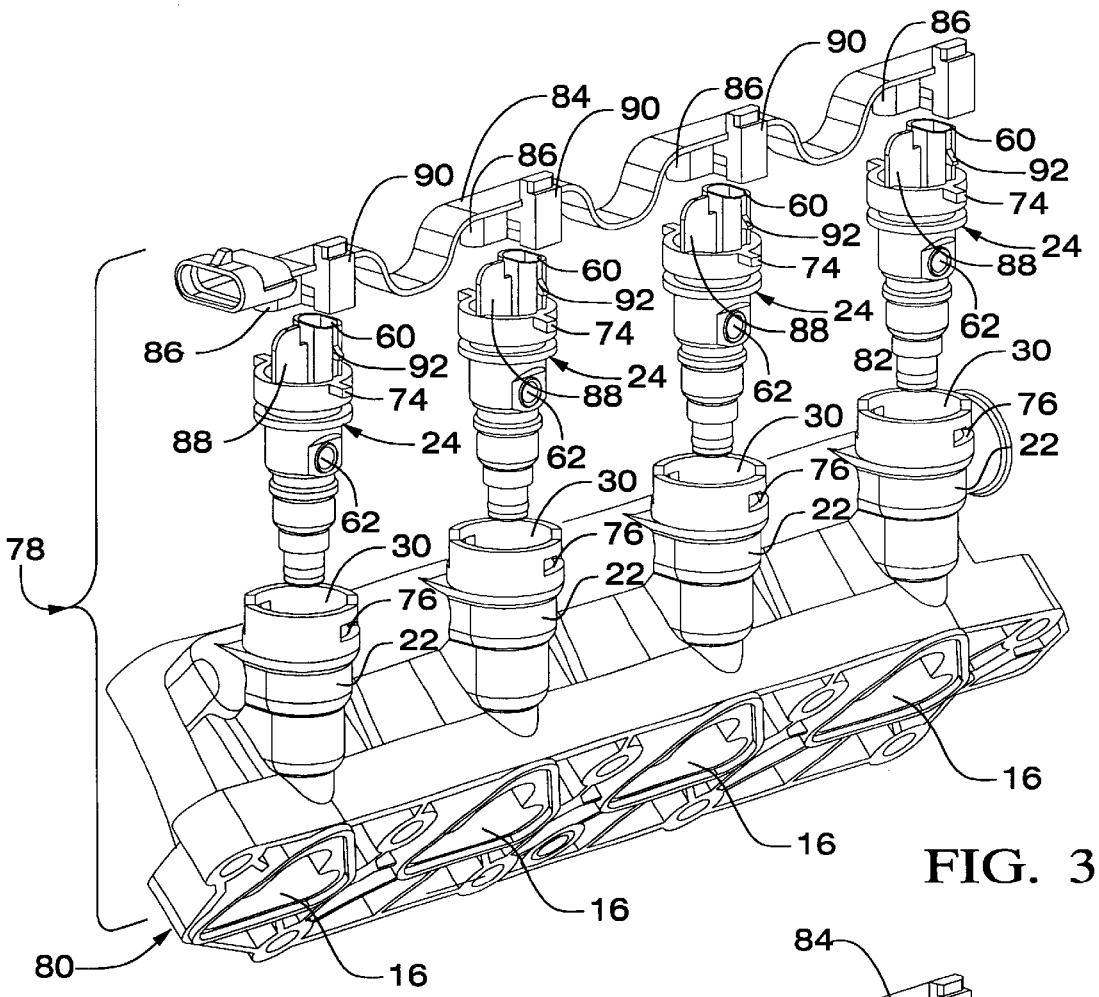
FIG. 3 is an exploded pictorial view of an alternative embodiment of manifold assembly utilizing twist lock injector retention.
Figure 4:
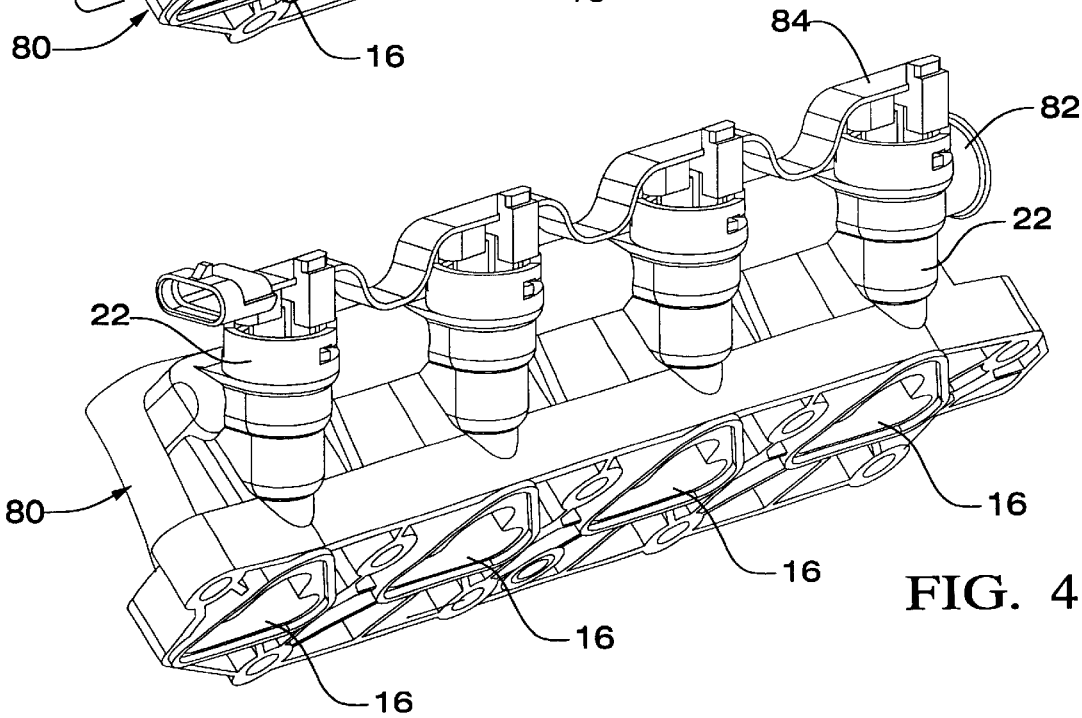
FIG. 4 is a pictorial view showing the embodiment of FIG. 3 as assembled.
Figure 5:
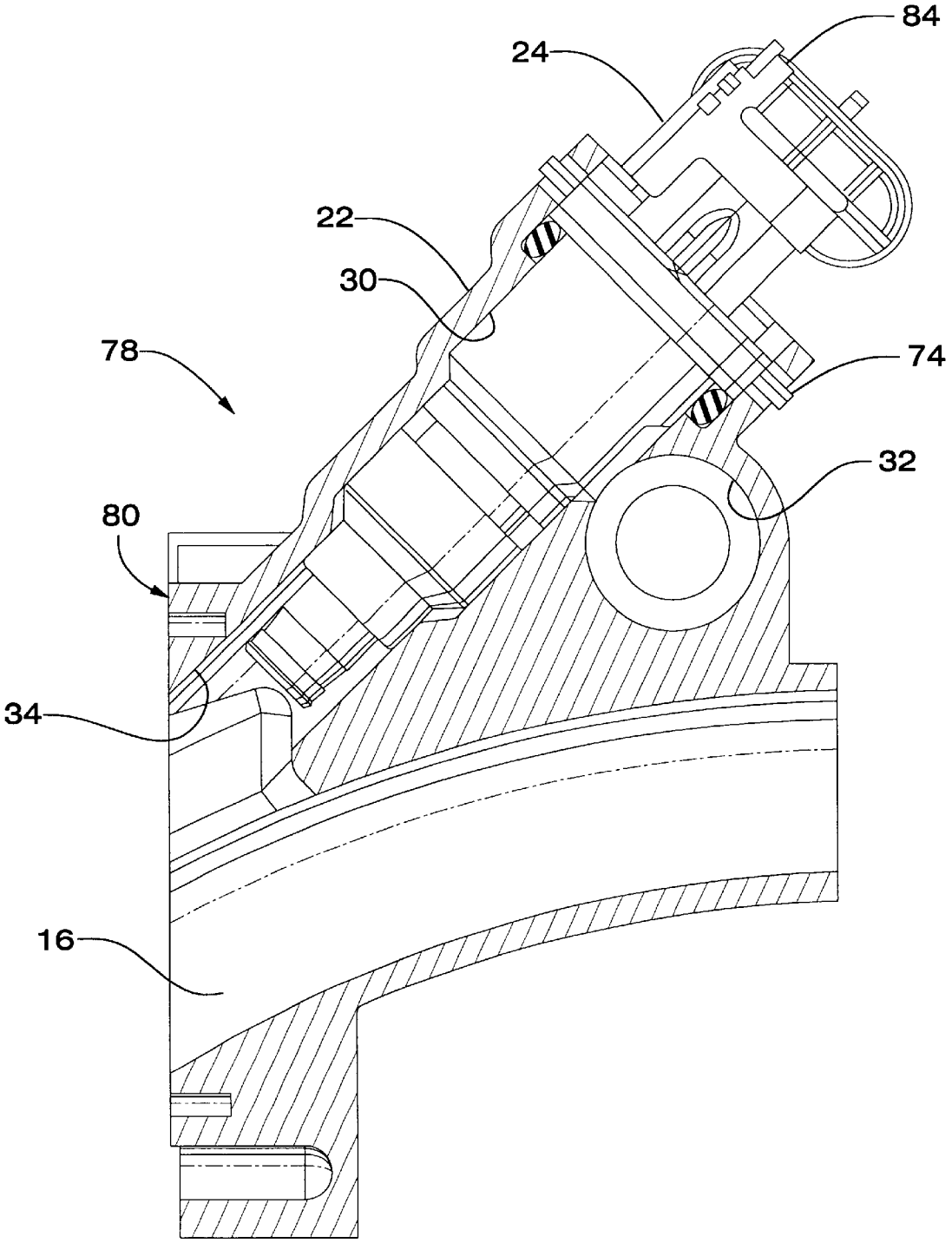
FIG. 5 is a cross-sectional view showing mounting of a side feed fuel injector within the manifold of FIG. 4.

Referring now to FIGS. 3–5, there is shown an alternative manifold assembly 78 including a manifold 80 having a connecting portion 82 that internally defines a common fuel passage 32 (FIG. 5). Passage 32 extends longitudinally, connecting internally with injector pockets 30 formed within the pods 22. Side feed fuel injectors 24 are mounted in each of the pockets 30, as before, with the side feed openings 62 positioned to communicate with the common fuel passage 32. A single piece semi-flexible fuel injector connector 84 is electrically connected to each of the connector sockets 60. Slotted guides 86 engage blades 88 on the injectors to assure their proper orientation and latch devices 90 engage retainers 92 to maintain the connector elements in assembly with the injectors until released. Lugs 74 engage the L-shaped slots 76 at the second, or outer, ends of the injector pockets to retain the injectors in place with a twist lock connection in assembly, as shown in FIG. 4. The injectors operate to spray fuel into the air intake passages 16 shown through the mounting face of the manifold 80.

As shown in FIG. 5, the air intake passages 16 connect with the bottom or one end 34 of the injector pockets 30. Injectors 24 are fed with fuel by the common fuel passage 32.

Figure 6:
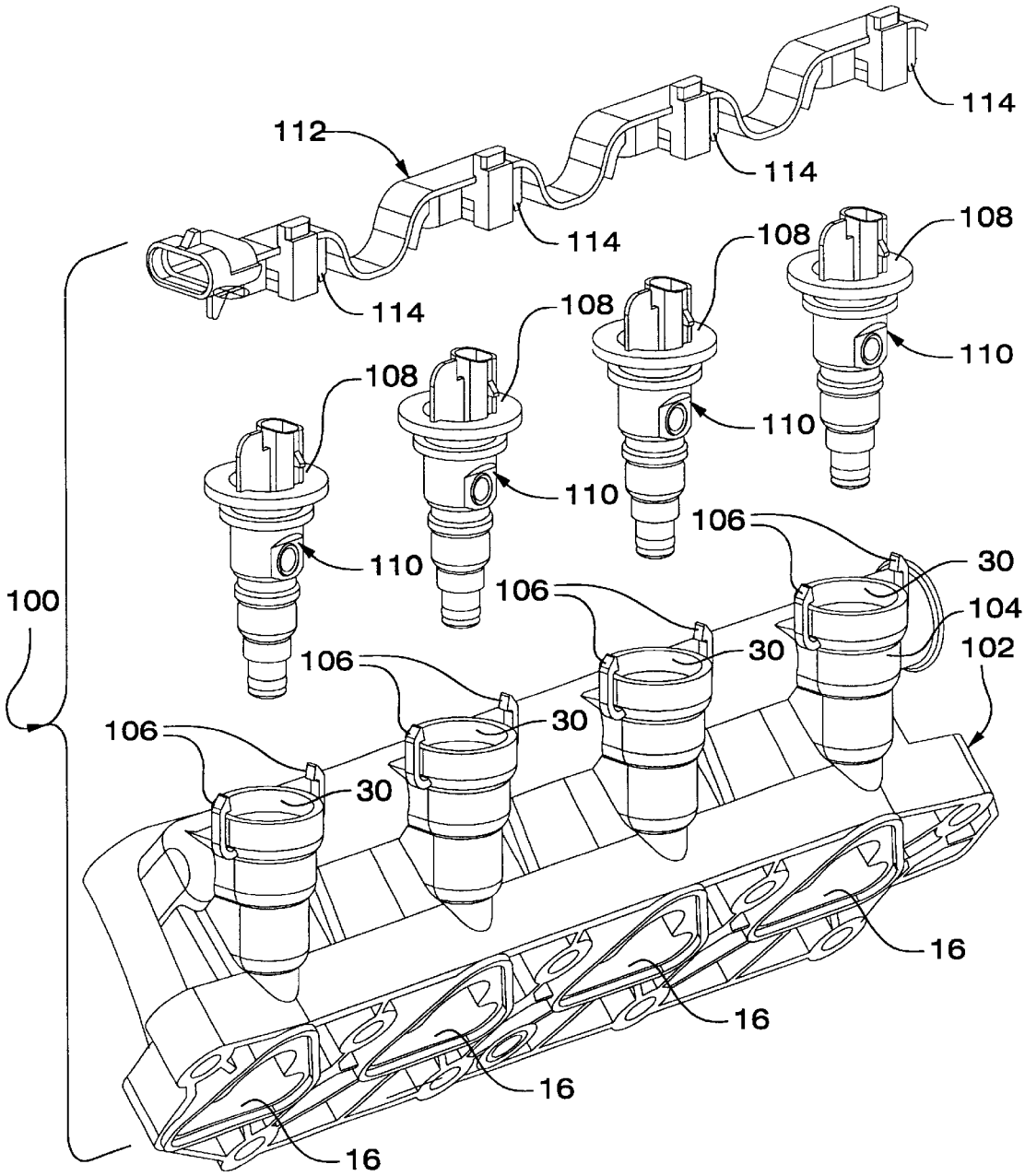
FIG. 6 is an exploded pictorial view illustrating a manifold assembly with snap-in injectors.

FIG. 6 illustrates an alternative embodiment of manifold assembly 100 which is generally similar to the embodiment of FIGS. 3–5 but differs in the following ways. The manifold 102 includes pods 104 in which the L-shaped retainer openings are replaced by resilient fingers 106 having hook ends that are engagable with cooperating edges 108 of associated side feed fuel injectors 110. A modified fuel injector connector 112 includes downwardly angled protrusions 114 which, in assembly, engage outer surfaces of the fingers 106 to prevent the hook ends from releasing the injectors while the connector 112 is installed. In other ways, the manifold assembly 100 is like that of assembly 78 in FIGS. 3–5.

Figure 7:
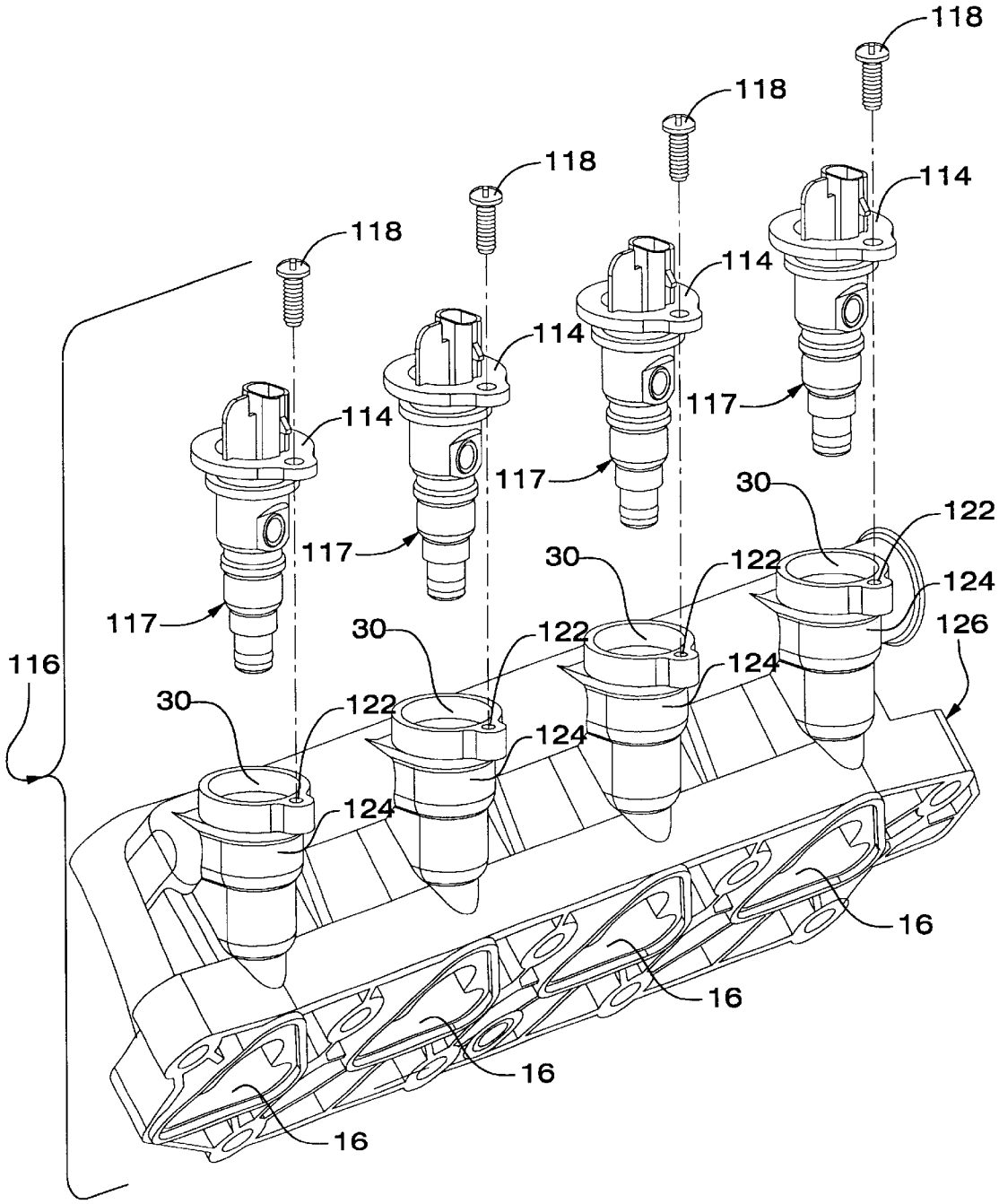
FIG. 7 is an exploded pictorial view illustrating a manifold assembly with screw attached injectors.

FIG. 7 illustrates still another alternative embodiment of manifold assembly 116 which is, again, similar to the embodiment of FIGS. 3–5 and differs only in the manner of retaining the injectors 117. In FIG. 7, the injectors 117 are retained by screws 118 that pass through tang openings 120 and engage threaded openings 122 in the ends of the injector receiving pods 124 of the manifold 126.

Figure 8:
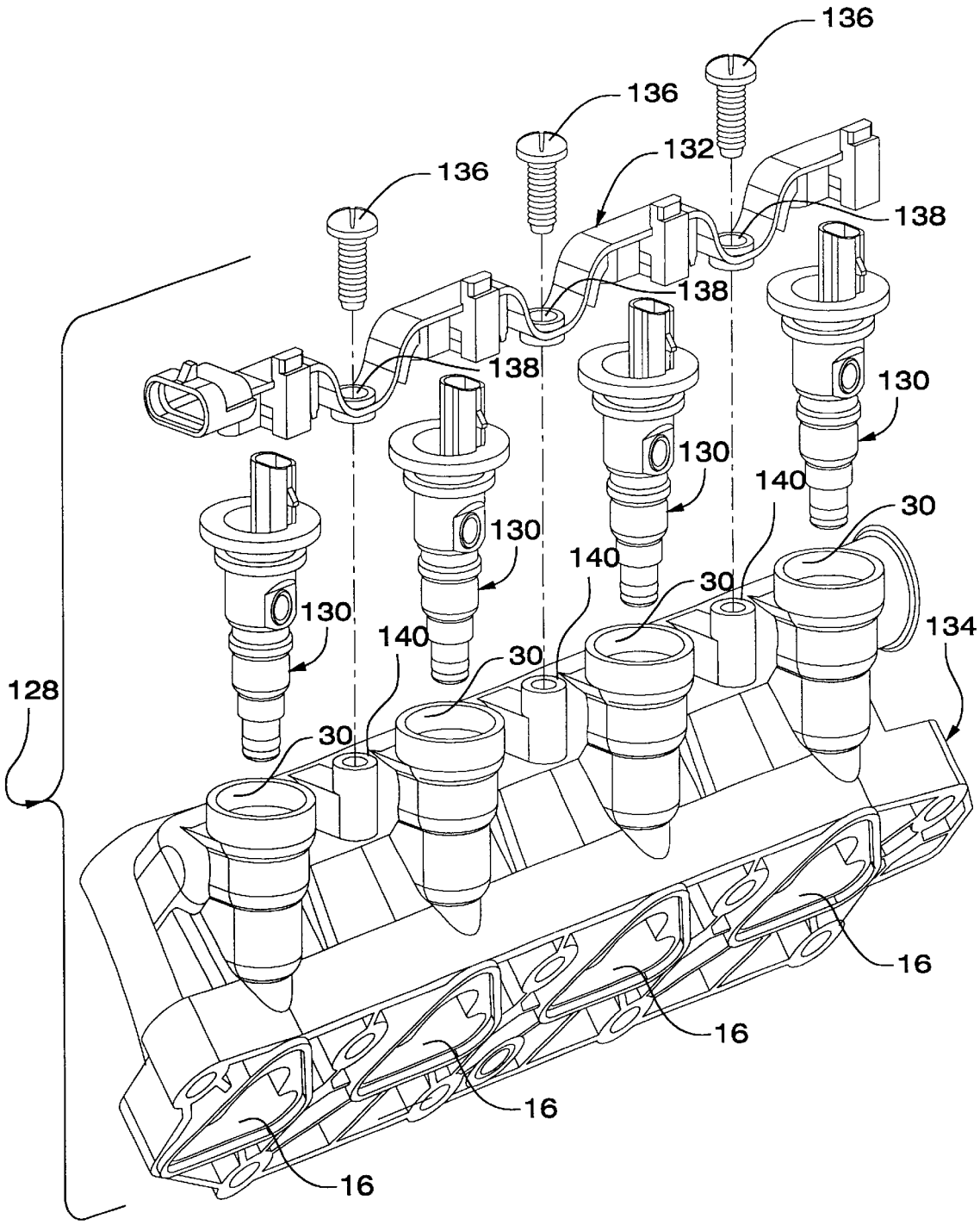
FIG. 8 is an exploded pictorial view showing a manifold assembly with injectors retained by a semi-flexible fuel injector connector.

FIG. 8 illustrates yet another embodiment of manifold assembly 128, wherein the injectors 130 are retained by a common connector 132. The connector 132 is held to the manifold 134 by screws 136 which extend through openings 138 in the connector to engage threaded bosses 140 in the manifold body.

Figure 9:
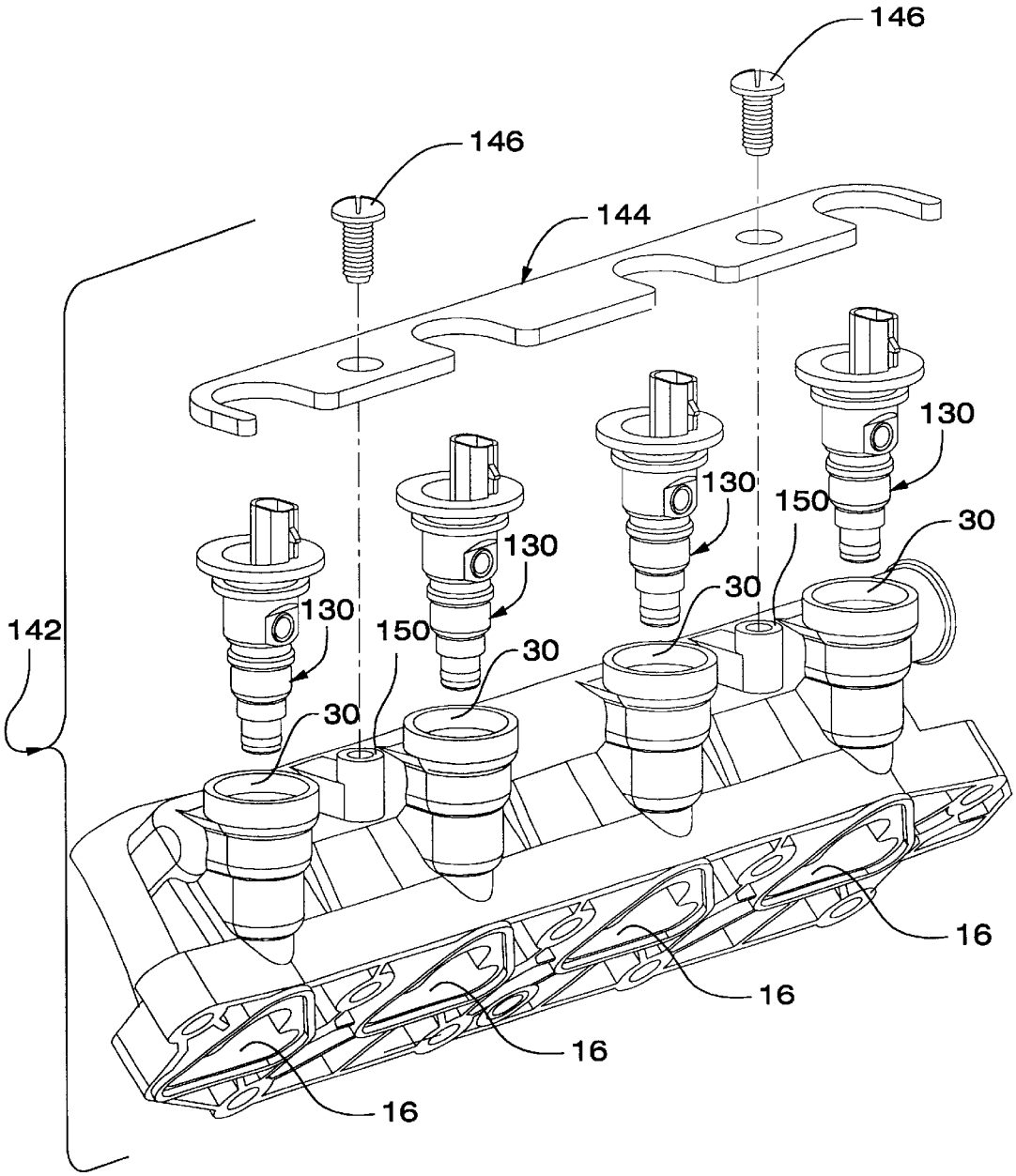
FIG. 9 is an exploded pictorial view showing a manifold assembly with injectors retained by a screw attached retaining plate.

FIG. 9 shows an additional embodiment of manifold assembly 142, wherein the injectors 130 are retained by a retainer bar 144 secured against the ends of the injectors by screws 146 that pass through openings 148 in bar 144 and engage threaded bosses 150 of the manifold 152.

To summarize, FIGS. 3 through 9 show various similar forms of manifold assemblies which differ essentially only in the manner in which the side feed injectors of the assemblies are retained in the injector pockets 30 of each of the manifolds of the various assemblies.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An engine intake manifold, said manifold comprising:

a plurality of air intake passages adapted for communication with associated engine cylinder inlet ports;

a plurality of drop-through injector pockets formed in the manifold, each of the pockets communicating at one end with an associated one of the air intake passages and open at an opposite second end for receiving and operation with a side feed fuel injector;

at least one common fuel passage acting as a fuel rail formed integral with said manifold and communicating with a plurality of said injector pockets adjacent their second ends for supplying fuel to said pockets and adapted to supply fuel to inlets of associated side feed fuel injectors when received in said pockets;

a side feed injector in each of said pockets and having opposite nozzle and connector ends, said nozzle ends extending into said one end of each pocket, electrical connectors on said connector ends adjacent said second end of each pocket, and at least one side feed opening in each injector spaced toward said connected end and communicating the common fuel passage of the manifold with the interior of the injector and with an axially centered central fuel passage through the injector leading to said nozzle end;

wherein said central fuel passage of each injector extends from said side inlet through the center of an electrical actuating coil and an associated armature connected with a nozzle valve adjacent the nozzle end of each injector.

2. A manifold assembly as in claim 1 and including retaining means securing the injectors in their respective pockets.

3. A manifold assembly as in claim 2 wherein the retaining means include resilient fingers at said second end of each of the pockets and having hook ends engaging cooperating snap-in edges of the associated injectors to retain the injectors in the pockets.

4. A manifold assembly as in claim 2 wherein the retaining means include screw receiving tabs on said other ends of the pockets and receiving hold down screws retaining the injectors in the pockets.

5. A manifold assembly as in claim 2 wherein the retaining means include a retainer bar engaging said second ends of a plurality of the injectors, and fasteners securing the retainer bar to the manifold.

6. A manifold assembly as in claim 2 wherein the retaining means include an electrical connector connecting with a plurality of said injectors in adjacent pockets of the manifold and fastening means retaining the connector to the manifold and holding the injectors in the pockets.

7. A manifold assembly as in claim 2 wherein the retaining means include a cylindrical wall having L-shaped slots at said second end of each of the pockets and receiving twist lock lugs extending from the associated injectors to orient and retain the injectors in said pockets.

8. A manifold assembly as in claim 1 and including an electrical connector connecting with a plurality of said injectors in adjacent pockets of the manifold.

9. A manifold assembly as in claim 8 wherein said electrical connector includes means preventing the release of retaining means holding the injectors in said pockets.

10. A manifold assembly as in claim 1 wherein said manifold further defines a plenum communicating with said air intake passages for providing air to such associated engine cylinder inlet ports.

11. An engine fuel injector comprising:

a body including a nozzle end and a connector end;

said nozzle end including an injection assembly having an electrical actuating coil, an injection valve actuated by the coil and an orificed valve seat controlled by the injection valve;

said connector end including an electrical connector electrically connected with the coil and adapted for connection with an electric power source for actuating the coil; and an internal fuel passageway leading from the exterior of the body to the valve seat, the passageway including an axially centered central fuel passage extending from the injection valve through the coil to a side feed opening in the body between the injection assembly and the connector end of the body.

* * * * *